US011738590B1

(12) United States Patent
Johnson

(10) Patent No.: US 11,738,590 B1
(45) Date of Patent: Aug. 29, 2023

(54) BLENDING STUMP PENCIL DEVICE

(71) Applicant: Michael Johnson, Carson City, NV (US)

(72) Inventor: Michael Johnson, Carson City, NV (US)

( * ) Notice: Subject to any disclaimer, the term of this patent is extended or adjusted under 35 U.S.C. 154(b) by 0 days.

(21) Appl. No.: 17/862,481

(22) Filed: Jul. 12, 2022

Related U.S. Application Data

(60) Provisional application No. 63/312,427, filed on Feb. 22, 2022.

(51) Int. Cl.
*B43K 29/00* (2006.01)
*B43K 19/02* (2006.01)
*B43K 29/18* (2006.01)

(52) U.S. Cl.
CPC ..... *B43K 29/00* (2013.01); *B43K 19/02* (2013.01); *B43K 29/18* (2013.01)

(58) Field of Classification Search
CPC ..... B43K 19/02; B43K 29/00; B43K 29/002; B43K 29/18; B43K 29/003; B43K 29/004; B43K 29/007
USPC ..... 401/52, 37; 15/424, 425, 427
See application file for complete search history.

(56) References Cited

U.S. PATENT DOCUMENTS 5,077,903 A * 1/1992 Kreim ..... B43L 23/02 30/453
6,026,960 A * 2/2000 Cogliano ..... A63H 3/005 206/457
6,547,465 B1 * 4/2003 Rago ..... B43K 29/02 15/430
2014/0084577 A1 * 3/2014 Chettle ..... A63F 3/068 283/67

* cited by examiner

*Primary Examiner* — David J Walczak
(74) *Attorney, Agent, or Firm* — Brennan, Manna & Diamond, LLC

(57) ABSTRACT

A novel blending stump pencil device that provides a user with one implement for both drawing and blending. The device comprises a wood-bodied pencil with a blending stump attached to a rear of the pencil via a securing apparatus. The device comprises a clear finish and a removable plastic sleeve that protects the blending stump from damage and debris. Further, the device can be included in a kit with multiple pencil types.

7 Claims, 4 Drawing Sheets

BLENDING STUMP PENCIL DEVICE

CROSS-REFERENCE TO RELATED APPLICATION

The present application claims priority to, and the benefit of, U.S. Provisional Application No. 63/312,427, which was filed on Feb. 22, 2022 and is incorporated herein by reference in its entirety.

FIELD OF THE INVENTION

The present invention relates generally to the field of blending stump devices. More specifically, the present invention relates to an improved blending stump pencil device that provides users with a pencil having a blending stump secured to it. Accordingly, the present disclosure makes specific reference thereto. Nonetheless, it is to be appreciated that aspects of the present invention are also equally applicable to other like applications, devices and methods of manufacture.

BACKGROUND

By way of background, artist pencils are well known and are often used for drawing and writing. The artist pencils are typically comprised of lead pencils and may have a graphite center for drawing in gray or black on a paper or page. Further, the lead pencils may have a colored center for drawing in colors, such as red, green or blue, on a paper or page. At a sharp end of the lead pencils, there is a tip or point of the graphite or lead center extending from a conical portion of the body which surrounds the graphite or lead center. When the tip or point breaks or wears out, a user need only to sharpen the lead pencil to remove additional body material surrounding the graphite or lead center in order that a new tip or point of graphite appears for writing or drawing. As the tip or point of graphite is dragged across an object, such as paper, graphite or color can be left behind on the object to leave a mark. In some cases, particularly when drawing, it is desirable to smudge or blend the graphite or color and the marks using a blending stump.

Typically, most artists and other users have a separate utensil for blending and smudging, which is a blending stump. The blending stump is a utensil that can be rubbed over parts of a drawing to blend or smudge the markings together. A user need only to rub the blending stump over a mark on the object and the graphite or color of the mark is blended together. However, in order to use the blending stump, a user must put down the artist pencil and pick up the blending stump. Constantly switching between multiple tools can be frustrating. Further, needing multiple tools and/or implements can limit storage space, leading to cluttered and disorganized storage boxes, drawers, etc.

Thus, it is necessary for users to constantly switch between multiple tools when using artist pencils and blending stumps. Further, artists and other users must have additional storage to house the multiple implements. Therefore, users require a device that allows them to only need one implement for both drawing and blending.

Therefore, there exists a long-felt need in the art for a blending stump pencil device that provides a user with one implement for both drawing and blending. There is also a long-felt need in the art for a blending stump pencil device that eliminates the need for users to store multiple drawing and blending implements. Further, there is a long-felt need in the art for a blending stump pencil device that simplifies the process of drawing and blending by providing both a pencil and a blending stump on one device. Moreover, there is a long-felt need in the art for a device that offers a unique pencil and blending stump combination to help keep a user organized. Further, there is a long-felt need in the art for a blending stump pencil device that can be included in a kit with several different pencil types and sandpaper for cleaning the blending stump. Finally, there is a long-felt need in the art for a blending stump pencil device that includes a plastic sleeve that protects the blending stump from damage and debris, when not in use.

The subject matter disclosed and claimed herein, in one embodiment thereof, comprises a blending stump pencil device. The device is designed to provide a user with one implement for both drawing and blending. The device comprises a wood-bodied pencil with a blending stump attached to a rear of the pencil via a securing means. The device comprises a clear finish and a removable plastic sleeve that protects the blending stump from damage and debris. Further, the device can be included in a kit with multiple pencil types.

In this manner, the blending stump pencil device of the present invention accomplishes all of the foregoing objectives and provides users with a one device for both drawing and blending. The device allows a user to simply and efficiently draw, and blend as needed. The device eliminates the use of multiple drawing and blending implements and offers a way for users to stay organized while drawing.

SUMMARY OF THE INVENTION

The following presents a simplified summary in order to provide a basic understanding of some aspects of the disclosed innovation. This summary is not an extensive overview, and it is not intended to identify key/critical elements or to delineate the scope thereof. Its sole purpose is to present some general concepts in a simplified form as a prelude to the more detailed description that is presented later.

The subject matter disclosed and claimed herein, in one embodiment thereof, comprises a blending stump pencil device. The device is designed to provide a user with one implement for both drawing and blending. The device comprises a wood-bodied pencil with a blending stump attached to a rear of the pencil via a securing means. The securing means comprises a metal attachment piece or plastic band, or any other suitable securing means as is known in the art.

In another embodiment, the blending stump pencil device comprises a lead center, outer casings which surround the lead center, and an outer skin. The lead center may be formed of a graphite composite, a wax, or other known marking medium to form black or color erasable marks. The casings may be formed of wood parts, such as cedar, plastic, a composite material, or other suitable materials. The outer skin may be a lacquer or other protective coating, painted and/or printed onto the casing. The blending stump would typically be manufactured of paper, non-erasing rubber, vinyl, silicon, etc., or other suitable blending materials as is known in the art.

In another embodiment, the pencil of the device comprises a clear finish or lacquer to protect the pencil from damage. Further, the blending stump of the device comprises a removable plastic sleeve that covers the blending stump and protects the blending stump from damage and debris when not in use.

In another embodiment, the blending stump pencil device can be included in a kit with multiple pencil types. The kit can also include sandpaper or any other suitable material that can be used to remove or clean lead from the blending stump when the blending stump becomes too stained with lead to function properly. Specifically, as the blending stump is rubbed over surfaces of objects, some lead can be rubbed off onto the blending stump, staining the blending stump and rendering it needing to be cleaned with sandpaper or other such materials.

In another embodiment, the blending stump pencil device comprises a plurality of indicia on the pencil and/or the blending stump.

In yet another embodiment, a method of providing a user with the ability to draw and blend with one instrument is described. The method includes the steps of providing a blending stump pencil device comprising a pencil and blending stump in one instrument. The method also comprises drawing with the pencil part of the blending stump pencil device. Further, the method comprises turning the device 180 degrees, such that the blending stump is accessible and ready for use. Finally, blending the drawing with the blending stump, wherein the device provides users with an efficient means for drawing and blending without requiring multiple implements.

In yet another embodiment of the present invention, a blending stump pencil device is disclosed for providing a user with one implement for both drawing and blending. The device comprises a wood-bodied pencil with a blending stump attached to a rear of the pencil via a securing means. The device comprises a clear finish and a removable plastic sleeve that protects the blending stump from damage and debris. Further, the device can be included in a kit with multiple pencil types. The device allows a user to simply and efficiently draw, and blend as needed. Thus, the device eliminates the use of multiple drawing and blending implements and offers a way for users to stay organized while drawing.

Numerous benefits and advantages of this invention will become apparent to those skilled in the art to which it pertains, upon reading and understanding the following detailed specification.

To the accomplishment of the foregoing and related ends, certain illustrative aspects of the disclosed innovation are described herein in connection with the following description and the annexed drawings. These aspects are indicative, however, of but a few of the various ways in which the principles disclosed herein can be employed and are intended to include all such aspects and their equivalents. Other advantages and novel features will become apparent from the following detailed description when considered in conjunction with the drawings.

BRIEF DESCRIPTION OF THE DRAWINGS

The description refers to provided drawings in which similar reference characters refer to similar parts throughout the different views, and in which.

DETAILED DESCRIPTION OF THE PRESENT INVENTION

Figure 1:
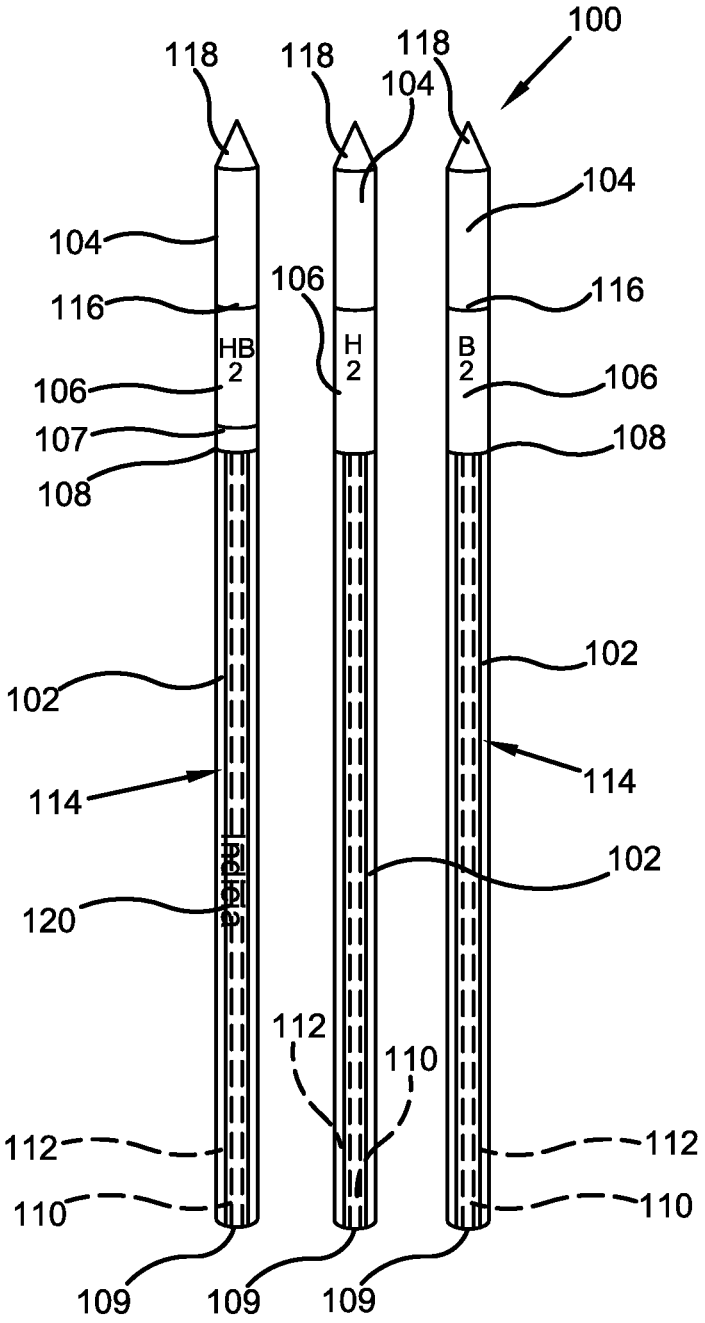
FIG. 1 illustrates a top perspective view of one potential embodiment of multiple blending stump pencil devices of the present invention in accordance with the disclosed architecture.

The innovation is now described with reference to the drawings, wherein like reference numerals are used to refer to like elements throughout. In the following description, for purposes of explanation, numerous specific details are set forth in order to provide a thorough understanding thereof. It may be evident, however, that the innovation can be practiced without these specific details. In other instances, well-known structures and devices are shown in block diagram form in order to facilitate a description thereof. Various embodiments are discussed hereinafter. It should be noted that the figures are described only to facilitate the description of the embodiments. They are not intended as an exhaustive description of the invention and do not limit the scope of the invention. Additionally, an illustrated embodiment need not have all the aspects or advantages shown. Thus, in other embodiments, any of the features described herein from different embodiments may be combined.

As noted above, there is a long-felt need in the art for a blending stump pencil device that provides a user with one implement for both drawing and blending. There is also a long-felt need in the art for a blending stump pencil device that eliminates the need for users to store multiple drawing and blending implements. Further, there is a long-felt need in the art for a blending stump pencil device that simplifies the process of drawing and blending, by providing both a pencil and a blending stump on one device. Moreover, there is a long-felt need in the art for a device that offers a unique pencil and blending stump combination to help keep a user organized. Further, there is a long-felt need in the art for a blending stump pencil device that can be included in a kit with several different pencil types and sandpaper for cleaning the blending stump. Finally, there is a long felt need in the art for a blending stump pencil device that includes a plastic sleeve that protects the blending stump from damage and debris, when not in use.

The present invention, in one exemplary embodiment, is a novel blending stump pencil device. The device is designed to provide a user with one implement for both drawing and blending. The device comprises a wood-bodied pencil with a blending stump attached to a rear of the pencil via a securing means. The device comprises a clear finish and a removable plastic sleeve that protects the blending stump from damage and debris. Further, the device can be included in a kit with multiple pencil types. The present invention also includes a novel method of providing a user with the ability to draw and blend with one instrument. The method includes the steps of providing a blending stump pencil device comprising a pencil and blending stump in one instrument. The method also comprises drawing with the pencil part of the blending stump pencil device. Further, the method comprises turning the device 180 degrees, such that the blending stump is accessible and ready for use. Finally, blending the drawing with the blending stump.

Referring initially to the drawings, FIG. 1 illustrates a perspective view of one embodiment of the blending stump pencil device 100 of the present invention. In the present embodiment, the blending stump pencil device 100 is an improved blending stump pencil device that provides users with one implement for both drawing and blending. The device 100 is especially designed to allow artists, any user wanting to draw and/or blend, etc., or any other suitable user as is known in the art, to easily draw and blend with one implement. More specifically, the device 100 comprises a pencil 102 with a blending stump 104 attached to a rear 108 of the pencil 102 via a securing means 106. The pencil 102 can be any suitable pencil as is known in the art, depending on the needs and/or wants of a user. Further, the blending stump 104 can be any suitable blending stump as is known in the art, depending on the needs and/or wants of a user. Additionally, the securing means 106 can comprise a band, a metal attachment component, etc., or any other suitable securing means as is known in the art, depending on the needs and/or wants of a user.

Furthermore, the pencil 102 of the blending stump pencil device 100 comprises a lead center 110, outer casings 112 which surround the lead center 110, and an outer skin 114. The lead center 110 may be formed of a graphite composite, a wax, or other known marking medium to form black or color erasable marks. The outer casings 112 may be formed of wood parts, such as cedar, plastic, a composite material, or other suitable materials. The outer skin 114 may be a lacquer or other protective coating, painted and/or printed onto the outer casings 112. The blending stump 104 would typically be manufactured of paper, non-erasing rubber, vinyl, silicon, etc., or other suitable blending materials as is known in the art.

The device 100 comprises a pencil 102 and a blending stump 104. The elements and formation of the pencil 102 are well known in the art. The blending stump 104 is a fixed or non-replaceable blending stump. The blending stump 104 is typically formed by folding multiple pieces of paper into a conical-shaped component. One end 116 of the blending stump 104 is coupled to one end (rear) 108 of the pencil 102. Note that the blending stump 104 is fixed and does not move with respect to the pencil 102. That is, the blending stump 104 does not extend out or dispense from the pencil 102. Nor does the blending stump 104 retract into the pencil 102.

Generally, the blending stump 104 is formed via rolling a rectangle size of soft paper tightly from right to left. The paper stump that is formed is then taped, such that the roll of paper is held closely together and does not unroll again. Further, the side of the paper stump that has no hole, is then sharpened and/or cut to a point, typically with box cutters, until it looks like a pencil made of paper. Finally, sandpaper can be used to clean the sides and tip and remove any irregularities, as well as prepare the blending stump for use.

The blending stump 104 is dimensioned to slide over the pencil 102 and be secured to its end 108. The blending stump 104 includes a band or metal attachment 106 on an outer surface to engage the pencil 102. The blending stump 104 may further include a flange or lip 107 to butt up against or overlap an edge 108 of the pencil 102 to deter further movement in one direction, when the blending stump 104 is in use.

The pencil 102 includes a butt end (or rear) 108 and a writing or sharpenable end 109. The butt end 108 of the pencil 102 is coupled into an end 116 of the blending stump 104. In one embodiment, the pencil 102 may be specifically dimensioned to couple with the blending stump 104.

The blending stump 104 includes a butt end 116 and a blendable end 118. The butt end 116 of the blending stump 104 is coupled into an end 108 of the pencil 102. The blending stump 104 may be specifically dimensioned to couple with the pencil 102.

In one embodiment, the securing means 106 is a band or a metal attachment. The securing means 106 acts like a bushing to join together the pencil 102 and the blending stump 104. The blending stump 104 has an end 116 which is dimensioned to receive the cross-sectional dimension of the securing means 106. The pencil 102 has an opening at the end (or rear) 108 which is dimensioned to receive the cross-sectional dimension of the securing means 106. The pencil 102 and the blending stump 104 are inserted into the securing means 106 and secured together.

The writing instrument or pencil 102 is assembled by inserting an end 108 of the pencil 102 into an end 116 of the blending stump 104, such that their ends 108 and 116 abut each other. A securing means 106 is then used to secure the blending stump 104 to the pencil 102. Specifically, a band or metal attachment component is crimped, clamped, or somehow secured around the abutting ends 108 and 116 of the pencil 102 and blending stump 104.

The pencil 102 is coaxial with a writing core, lead core or lead center; a barrel, sheath or casing around the lead center 110; and an outer skin or coating 114 around the casings 112. In an alternate embodiment, the pencil 102 may include other intermediate layers of materials to provide additional protection to the lead center 110 and avoid breakage of the pencil 102. The pencil 102 is generally cylindrically shaped, but could also be hexagonally shaped, circular shaped, rectangular shaped, square shaped, or triangular shaped, etc., or any other suitable shape as is known in the art. The lead center 110, casing 112, and coating 114 are generally cylindrically shaped along the length of the pencil 102, when the pencil is unsharpened. When sharpened, the coaxial layers are removed to expose the lead center 110.

The pencil 102 provides no mechanical means for extending the lead center 110 out from the casing 112. The pencil 102 is non-mechanical and requires sharpening in order to peel the outer skin and the casing away from the lead center 110 so that the writing tip 109, or point of the lead center, is exposed. In other words, the lead center 110, casing 112, and outer skin or coating 114 are coupled together, such that the lead center 110 is in a fixed position.

In any case, the lead center 110 may also be referred to as a writing core, a lead core, or a fixed lead center. The casing 112 may also be referred to as a barrel or a sheath. The coating 114 may also be referred to as an outer skin.

The lead center 110 may be formed of a graphite composite, a wax, or other known marking medium to form black or color erasable marks. In one embodiment, graphite is mixed with clay in various amounts to vary the hardness of the lead center. The casings 112 may be formed of wood parts, such as cedar, plastic, a composite material, or other known materials. The outer skin 114 may be a lacquer or other protective coating, painted and or printed onto the casing 112. The outer skin 114 of the pencil 102 may include advertising, a trademark, or other letters, designs, or characters, printed, painted, stamped, or integrated into the outer skin 114, or any other indicia 120 as is known in the art. Specifically, any suitable 120 indicia as is known in the art can be included, such as, but not limited to, patterns, logos, emblems, images, symbols, designs, letters, words, characters, animals, advertisements, brands, etc., that may or may not be drawing or art tool/brand related.

The blending stump 104 is a cylinder shape and cross-section. Specifically, the blending stump 104 can be a hexagonal-shaped cylinder having a hexagonal cross-section, a circular-shaped cylinder having a circular cross-section, a square-shaped cylinder having a square cross-section, a rectangular-shaped cylinder having a rectangular cross-section, or a triangular-shaped cylinder having a triangular cross-section, etc., or any other suitable shape as is known in the art. The diameter of the blending stump 104 may be similar to the diameter of the pencil 102 to use a uniformly sized securing means 106. The cross-sectional shape of the blending stump 104 may or may not be similar to the cross-sectional shape of the pencil 102.

Figure 2:
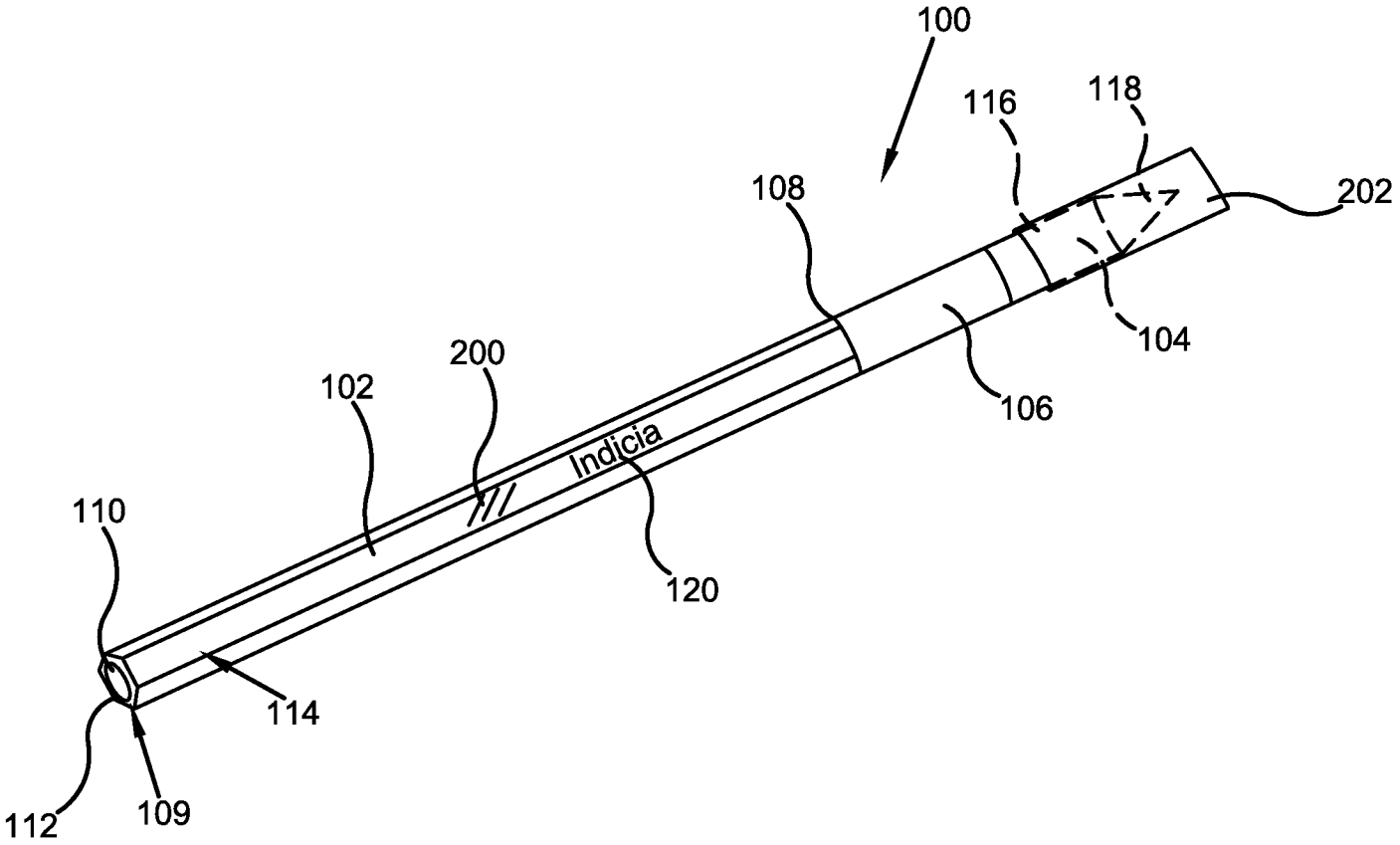
FIG. 2 illustrates a side perspective view of one potential embodiment of the blending stump pencil device of the present invention, wherein the blending stump is secured to the pencil via a band in accordance with the disclosed architecture.
Figure 3:
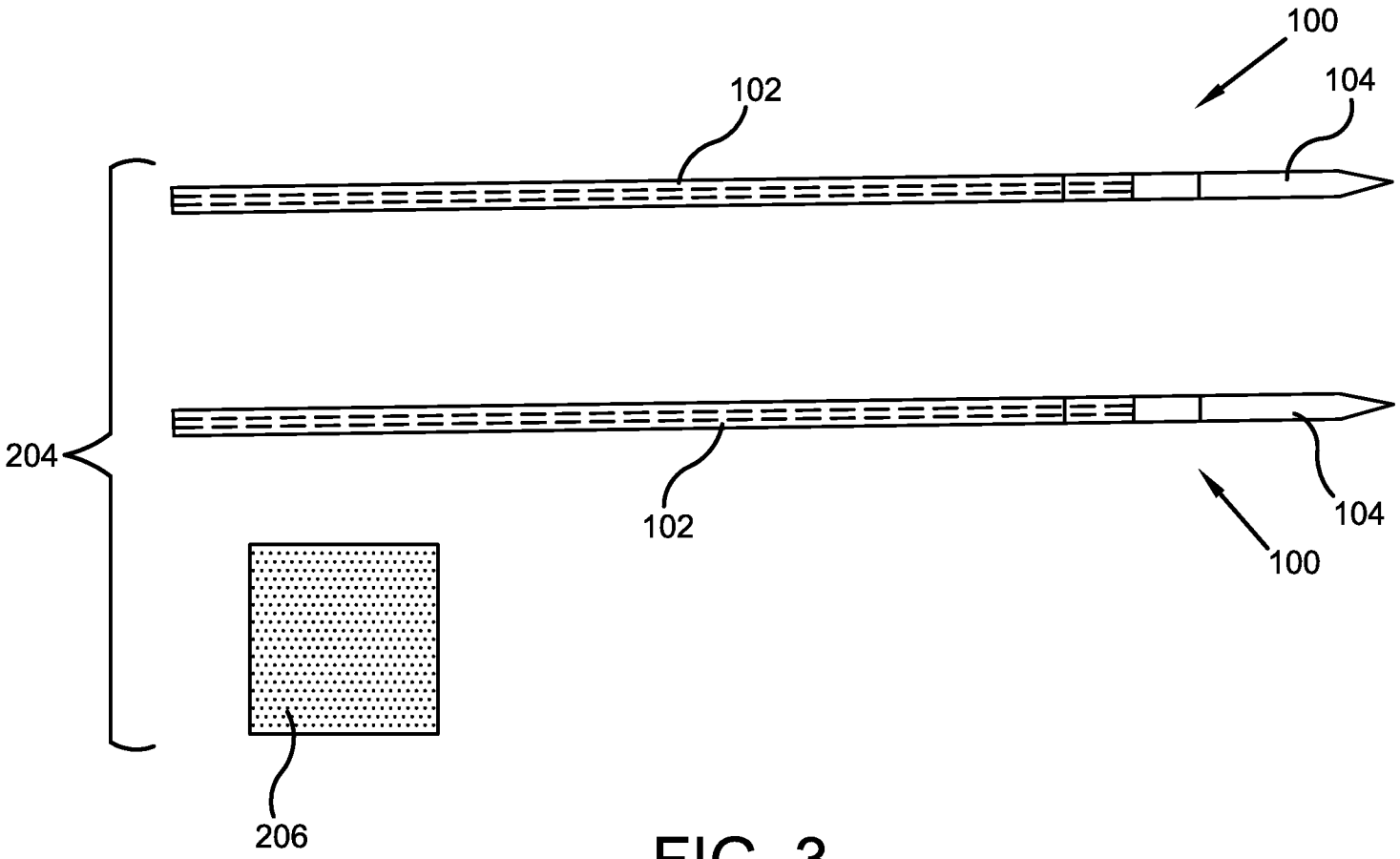
FIG. 3 illustrates a side perspective view of one potential embodiment of multiple blending stump pencil devices of the present invention, wherein the pencil and the blending stump have the same diameter in accordance with the disclosed architecture.

FIGS. 2-3 illustrates a perspective view showing the blending stump pencil device 100 comprising a pencil 102 and a blending stump 104. In this embodiment, the pencil 102 of the device 100 comprises a clear finish or lacquer 200 to protect the pencil 102 from damage. Further, the blending stump 104 of the device 100 comprises a removable plastic sleeve 202 that covers the blending stump 104 and protects the blending stump 104 from damage and debris when not in use.

In another embodiment, the blending stump pencil device 100 can be included in a kit 204 with multiple pencil types. The kit 204 can also include sandpaper 206 or any other suitable material that can be used to remove or clean lead from the blending stump 104 when the blending stump 104 becomes too stained with lead to function properly. Specifically, as the blending stump 104 is rubbed over surfaces of objects, some lead can be rubbed off onto the blending stump 104, staining the blending stump 104 and rendering it needing to be cleaned with sandpaper or other such materials.

Figure 4:
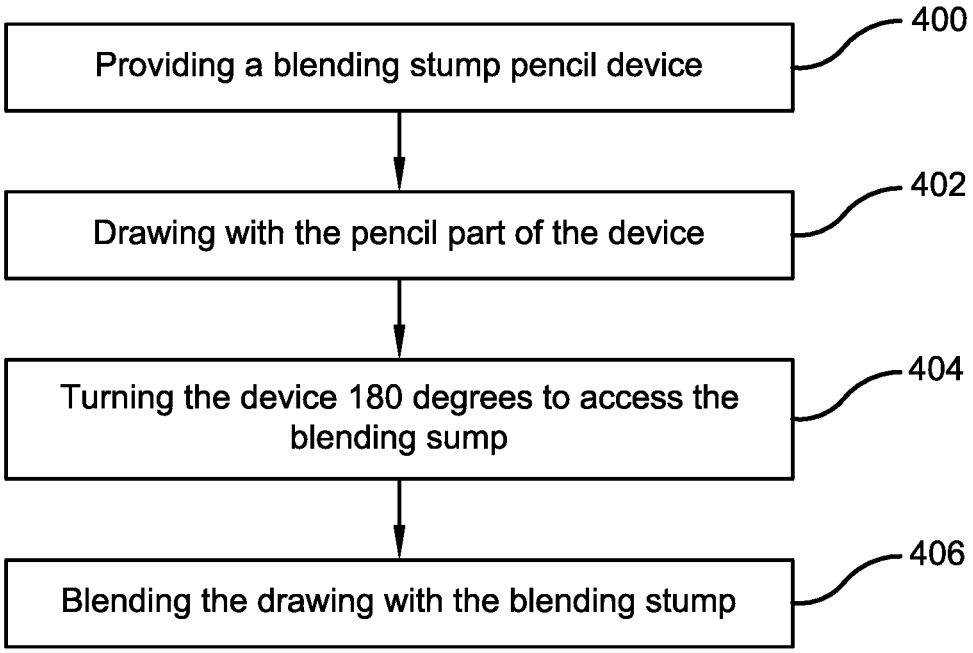
FIG. 4 illustrates a flowchart showing a method of providing a user with the ability to draw and blend with one potential embodiment of the blending stump pencil device of the present invention in accordance with the disclosed architecture.

FIG. 4 illustrates a flowchart of the method of providing a user with the ability to draw and blend with one instrument. The method includes the steps of at 400, providing a blending stump pencil device comprising a pencil and blending stump in one instrument. The method also comprises at 402, drawing with the pencil part of the blending stump pencil device. Further, the method comprises at 404, turning the device 180 degrees, such that the blending stump is accessible and ready for use. Finally, at 406, blending the drawing with the blending stump, wherein the device provides users with an efficient means for drawing and blending without requiring multiple implements.

Certain terms are used throughout the following description and claims to refer to particular features or components. As one skilled in the art will appreciate, different users may refer to the same feature or component by different names. This document does not intend to distinguish between components or features that differ in name but not structure or function. As used herein "blending stump pencil device" and "device" are interchangeable and refer to the blending stump pencil device 100 of the present invention.

Notwithstanding the foregoing, the blending stump pencil device 100 of the present invention can be of any suitable size and configuration as is known in the art without affecting the overall concept of the invention, provided that it accomplishes the above-stated objectives. One of ordinary skill in the art will appreciate that the blending stump pencil device 100, as shown in FIGS. 1-4 is for illustrative purposes only, and that many other sizes and shapes of the blending stump pencil device 100 are well within the scope of the present disclosure. Although the dimensions of the blending stump pencil device 100 are important design parameters for user convenience, the blending stump pencil device 100 may be of any size that ensures optimal performance during use and/or that suits the user's needs and/or preferences.

Various modifications and additions can be made to the exemplary embodiments discussed without departing from the scope of the present invention. While the embodiments described above refer to particular features, the scope of this invention also includes embodiments having different combinations of features and embodiments that do not include all of the described features. Accordingly, the scope of the present invention is intended to embrace all such alternatives, modifications, and variations as fall within the scope of the claims, together with all equivalents thereof.

What has been described above includes examples of the claimed subject matter. It is, of course, not possible to describe every conceivable combination of components or methodologies for purposes of describing the claimed subject matter, but one of ordinary skill in the art may recognize that many further combinations and permutations of the claimed subject matter are possible. Accordingly, the claimed subject matter is intended to embrace all such alterations, modifications and variations that fall within the spirit and scope of the appended claims. Furthermore, to the extent that the term "includes" is used in either the detailed description or the claims, such term is intended to be inclusive in a manner similar to the term "comprising" as "comprising" is interpreted when employed as a transitional word in a claim.

What is claimed is:

1. A blending stump pencil device that provides a user with a single implement for both drawing and blending, the blending stump pencil device comprising:

a pencil comprised of a lead center, an outer casing that surrounds the lead center, and an outer skin; and a blending stump secured to an end of the pencil via a securing means, wherein the blending stump is formed of a rolled up paper that is cut to a point and sanded before use.

2. The blending stump pencil device of claim 1, wherein the blending stump comprises a removable plastic sleeve that covers the blending stump and protects the blending stump from damage and debris when not in use.

3. The blending stump pencil device of claim 1, wherein the blending stump pencil device is included in a kit comprised of a plurality of different pencil types.

4. The blending stump pencil device of claim 3, wherein the kit comprises a sandpaper to remove or clean a lead from the blending stump.

5. The blending stump pencil device of claim 1 further comprising a plurality of indicia on the pencil or the blending stump.

6. The blending stump pencil device of claim 1, wherein the securing means comprises a metal attachment piece or a plastic band.

7. A method of providing a user with the ability to draw and blend on a piece of paper with a single instrument, the method comprising the steps of:

providing a blending stump pencil device comprised of a pencil and a blending stump;

creating a drawing on the piece of paper with the pencil;

turning the blending stump pencil device 180 degrees, such that the blending stump is accessible and ready for use; and blending the drawing with the blending stump, wherein the pencil is comprised of a lead center, an outer casing that surrounds the lead center, and an outer skin, and further wherein the blending stump is secured to an end of the pencil via a securing means and is formed of a rolled up paper that is cut to a point and sanded before use.

* * * * *